US010808520B2

(12) United States Patent
Taal

(10) Patent No.: US 10,808,520 B2
(45) Date of Patent: Oct. 20, 2020

(54) SMART WELL PLUG AND METHOD FOR INSPECTING THE INTEGRITY OF A BARRIER IN AN UNDERGROUND WELLBORE

(71) Applicant: SHELL OIL COMPANY, Houston, TX (US)

(72) Inventor: Jasper Jacob Willem Taal, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 154 days.

(21) Appl. No.: 16/064,359

(22) PCT Filed: Dec. 20, 2016

(86) PCT No.: PCT/EP2016/081920

§ 371 (c)(1),
(2) Date: Jun. 20, 2018

(87) PCT Pub. No.: WO2017/108789

PCT Pub. Date: Jun. 29, 2017

(65) Prior Publication Data

US 2018/0371895 A1 Dec. 27, 2018

(30) Foreign Application Priority Data

Dec. 22, 2015 (EP) ..... 15201976

(51) Int. Cl.
*E21B 47/06* (2012.01)
*E21B 47/117* (2012.01)
(Continued)

(52) U.S. Cl.
CPC ..... *E21B 47/06* (2013.01); *E21B 33/124* (2013.01); *E21B 49/00* (2013.01); *E21B 47/117* (2020.05)

(58) Field of Classification Search
CPC ..... E21B 47/1025; E21B 47/10; E21B 47/06; E21B 47/117
See application file for complete search history.

(56) References Cited

U.S. PATENT DOCUMENTS 6,408,943 B1 * 6/2002 Schultz ..... E21B 47/01 166/285
7,380,609 B2 * 6/2008 Page ..... E21B 33/035 166/191

(Continued)

OTHER PUBLICATIONS

International Search Report and Written Opinion received for PCT Patent Application No. PCT/EP2016/081920, dated May 9, 2017, 8 pages.

*Primary Examiner* — Catherine Loikith

(57) ABSTRACT

A test plug is proposed for inspecting the integrity of a cement plug or other barrier in an abandoned oil and/or gas production wellbore as well as its own sealing performance. The test plug employs a pair of expandable seals for sealing off an annular space between the seals, the plug and surrounding inner surface of the wellbore. Furthermore, it employs a pump for pumping fluid through a fluid channel traversing the plug into or from an intermediate wellbore section between the plug and the barrier. Valves are provided for closing the fluid channel after the pressure in the intermediate wellbore section has reached a selected level. Pressure gauges monitor a pressure in the intermediate wellbore section and in the annular space during a selected period of time. The monitored pressure is stored in a memory device and/or transmitted to a barrier and seal integrity monitoring display at the earth surface.

20 Claims, 1 Drawing Sheet

(51) Int. Cl.

| | |
|---|---|
| ***E21B 47/10*** | (2012.01) |
| ***E21B 33/124*** | (2006.01) |
| ***E21B 49/00*** | (2006.01) |

(56) References Cited

U.S. PATENT DOCUMENTS

| | | | | |
|---|---|---|---|---|
| 7,908,034 | B2 * | 3/2011 | Gray | E21B 21/00 175/24 |
| 8,113,044 | B2 * | 2/2012 | Montaron | E21B 29/10 166/250.11 |
| 8,650,934 | B1 | 2/2014 | Levy | |
| 9,797,218 | B2 * | 10/2017 | Duphorne | E21B 33/13 |
| 2013/0299165 | A1 * | 11/2013 | Crow | E21B 33/12 166/250.08 |
| 2014/0124197 | A1 | 5/2014 | Veeningen | |
| 2015/0159480 | A1 | 6/2015 | Kalyanaraman et al. | |
| 2015/0361782 | A1 * | 12/2015 | Kjorholt | E21B 33/13 166/250.14 |

* cited by examiner

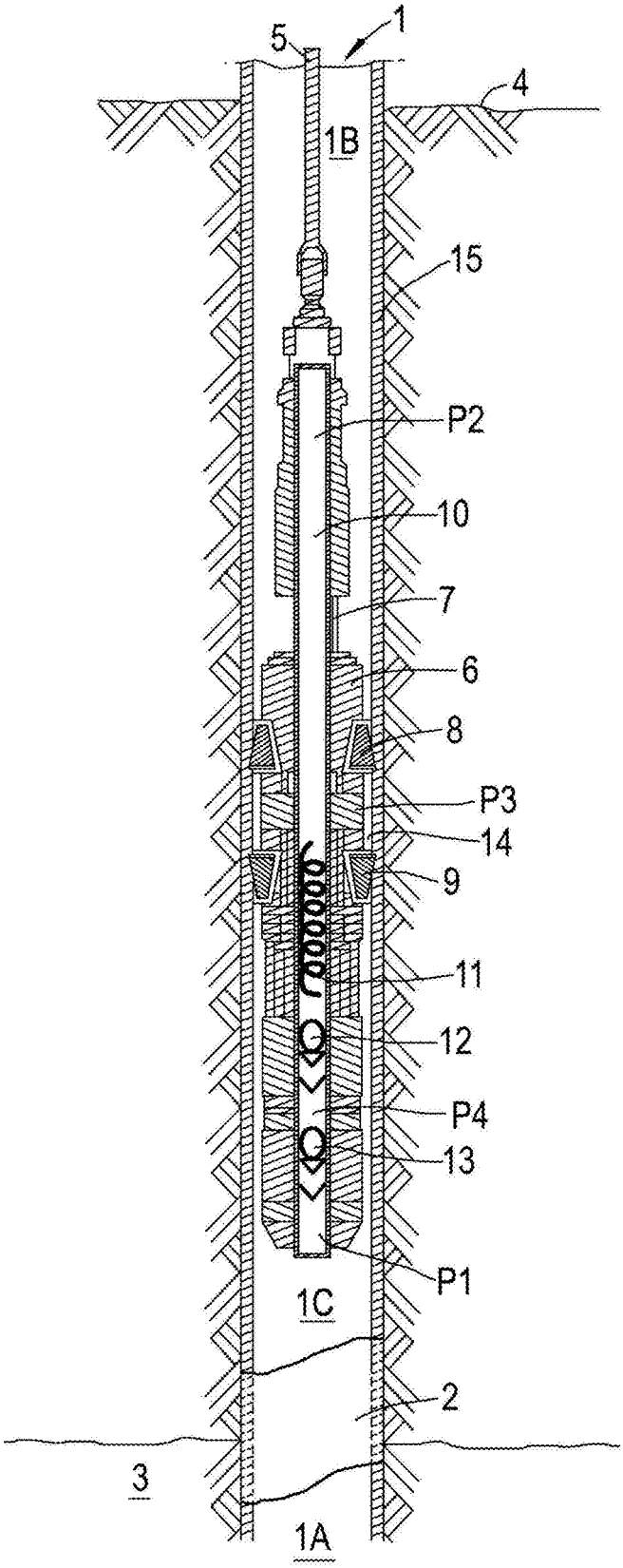
1
5
4
1B
15
P2
10
7
6
8
P3
14
9
11
12
P4
13
P1
1C
2
3
1A

SMART WELL PLUG AND METHOD FOR INSPECTING THE INTEGRITY OF A BARRIER IN AN UNDERGROUND WELLBORE

CROSS REFERENCE TO RELATED APPLICATIONS

This is a national stage application of PCT/EP2016/081920, filed 20 Dec. 2016, which claims benefit of priority of European application No. 15201976.6 filed 22 Dec. 2015.

FIELD OF THE INVENTION

The invention relates to a method and system for smart well plug and method for inspecting the integrity of a barrier in an underground wellbore.

BACKGROUND OF THE INVENTION

It is known to inspect the integrity of a barrier in an underground wellbore, such as a cement plug set in an abandoned oil and/or gas production well, by expanding a plug just above the barrier and injecting via a drill string or coiled tubing from which the plug is suspended into a well section between the barrier and the plug, whereupon after a predetermined pressure level has been reached in said space the injection is interrupted and the pressure in an upper section of the injection conduit above the wellhead is monitored during a selected period of time. In case the pressure decreases and exceeds a predetermined value then this is interpreted by a barrier integrity inspector that fluid may leak away from said space via the barrier in which case the barrier may be further sealed or another barrier needs to be installed above the existing leaking barrier.

A disadvantage of the known test plug is that the pressure is monitored at an upper end of the drill string or coiled tubing from which the test plug is suspended, which makes the test method susceptible to inaccurate measurements, due to temperature fluctuation and/or leakage of the drill string or coiled tubing, which may be kilometers long and therefore is a complex piece of equipment.

US 2015/0159480 A1 discloses a method of testing a barrier in a wellbore that includes isolating a volume in the wellbore between an isolation device connected with an apparatus and the barrier, and pressure testing the barrier using the apparatus to adjust the pressure in the volume. The apparatus can be conveyed in the wellbore at a desired depth against the barrier. The apparatus has a body that has the isolation device located thereabout. The body houses a pump, a chamber, a valve, pressure sensors, and other desired equipment or electronics. The pressure of the volume between the isolation device can be measured using transducers, pressure gauges, or the like that are connected with the apparatus. The acquired pressure data can be sent to the surface using now known or future known methods of telemetry.

There is a need for an improved well plug and barrier integrity monitoring method which overcome drawbacks of known systems.

SUMMARY OF THE INVENTION

In accordance with the invention there is provided a smart test plug for inspecting the integrity of a barrier in an underground wellbore, the plug comprising:

- a pair of expandable seals configured to seal off an annular space between the plug and surrounding inner surface of the wellbore;
- a pump for pumping fluid through a fluid channel traversing the plug between a lower wellbore section located between the plug and the barrier and an upper wellbore section located above the plug;
- means for closing the fluid channel after a pressure difference between the upper and lower wellbore sections has reached a selected level;
- pressure gauges for monitoring pressure in the upper and lower wellbore sections and in the annular space; and
- means for transmitting the pressures monitored by the pressure gauges to a barrier and test plug seal integrity monitoring display at the earth surface.

The plug may be connected to a wireline or coiled tubing, which may be provided with a power and data transmission assembly for activating the expandable seals, pump, valves and pressure gauges and for transmitting the monitored pressure to the barrier and test plug seal integrity monitoring display at the earth surface.

The barrier and test plug seal integrity monitoring display may be configured to indicate a lack of integrity of the barrier if after activating the pump to generate a pressure difference between the upper and lower wellbore sections and closing off the fluid channel the pressure gauge in the lower wellbore section measures a pressure change that exceeds a predetermined threshold during a selected period of time and to indicate a lack of sealing performance of at least one of the expandable seals if the pressure gauge in the annular space measures a pressure change that exceeds a predetermined value during the selected period of time.

In accordance with the invention there is further provided a method for assessing the integrity of a barrier in an underground wellbore wherein use is made of the smart test plug according to the invention.

The barrier may be a cement plug set in an abandoned oil and/or gas production well and the method may be used to verify whether the cement plug provides a fluid tight seal.

Optionally, the smart plug is suspended from a wireline and is lowered to a location just above an upper end of the cement plug.

Alternatively, the wellbore has a substantially horizontal or inclined bottom section and the smart plug may be connected to a robotic carrier tool which moves the smart plug to a position in the vicinity of the cement plug in the bottom section of the wellbore and the robotic carrier tool and/or the smart plug may comprise a battery for powering the expandable seal, the pump, the valve and the pressure gauge and wherein the robotic carrier tool and/or the smart plug may comprise a memory for monitoring the pressure in the wellbore section between the smart plug and cement plug and a wireless signal transmitter for transmitting the monitored pressure in the wellbore section between the smart plug and cement plug to a barrier integrity inspection display at the earth surface.

Optionally:

- the smart test plug comprises an upper and a lower part;
- the lower part comprises one of the expandable seals and remains permanently in place above the barrier; and
- the upper part comprises the other expandable seal and the pump and is lowered by a wireline or coiled tubing sealingly on top of the lower part when a barrier integrity test is performed and subsequently hoisted by the wireline to the earth surface and optionally the upper part is lowered again on top of the lower part if the integrity of the barrier is to be monitored again after an earlier test has been performed.

These and other features, embodiments and advantages of the expansion method and tool according to the invention are described in the accompanying claims, abstract and the following detailed description of non-limiting embodiment depicted in the accompanying drawing, in which description reference numerals are used which refer to corresponding reference numerals that are depicted in the drawing.

Objects and other features depicted in the Fig. and/or described in this specification, abstract and/or claims may be combined in different ways by a person skilled in the art.

BRIEF DESCRIPTION OF THE DRAWING

FIG. 1 is a longitudinal sectional view of an abandoned well in which the integrity of a cement barrier is inspected using the smart test plug according to the invention.

DETAILED DESCRIPTION OF THE DEPICTED EMBODIMENT

FIG. 1 shows an abandoned oil and/or gas production well 1 in which a cement plug 2 has been set to seal off a lower part 1A of the well 1 to inhibit residual oil and/or gas to flow from the partially depleted reservoir formation 3 via the well 1 to the earth surface 4. The interior of an upper part 1B of the well may be largely filled with water and contains a wireline 5 from which a smart test plug 6 according to the invention is suspended.

The smart test plug 6 comprises a tubular housing 7 surrounded by at least two longitudinally spaced inflatable or otherwise expandable sealing rings 8 and 9. The interior of the tubular housing 7 provides a fluid passage 10 in which a pump 11 and a pair of check valves 12 and 13. Optionally the check valves 12 and 13 may be replaced by remotely controlled bi-directional valves. The pump 11 may be powered by a power supply cable incorporated in the wireline 5 and/or by a battery and a remotely operated or automated control assembly (not shown) within the housing 7.

The smart test plug 6 is provided with four pressure gauges P1-P4. The first pressure gauge P1 is arranged near a lower end of the fluid passage 10 and measures an ambient pressure within the borehole section 1C between the smart test plug 6 and the cement barrier 2.

The second pressure gauge P2 is arranged near an upper end of the fluid passage 10 and measures an ambient pressure within the upper borehole section 1B above the seals 8 and 9 of the smart test plug 6. The third pressure gauge P3 measures an ambient pressure in the annular space 14 surrounding the housing 7 between the seals 8 and 9. The fourth pressure gauge P4 measures an ambient pressure in the fluid passage 10 between the check valves 12 and 13. The pressure gauge P1-P4 readings may be transmitted to a barrier and test plug seal integrity monitoring assembly at the earth surface 4 by a data transmission cable embedded in the wireline 5, a wireless data transmission link or stored in a memory device in the smart test plug 6.

When in use the smart test plug 6 is lowered into the well 1 to a depth just above the upper end of the cement plug 2. Subsequently the sealing rings 8 and 9 are expanded against the inner surface of a well casing 15 surrounding the wellbore and the pump 11 is activated to pump water or another well fluid into or from the space 1C between the smart test plug 6 and the cement plug 2. The pressure in the space 1C is monitored by the pressure gauge P1 and when the pressure has reached a selected level the pump 11 is stopped and the check valves 12 and 13 are automatically closed by the pressure differences between the upper and intermediate well sections 1B and 1C. Thereafter the pressure gauge P1 monitors the pressure in the intermediate well section 1C during a selected period of time, which may be several minutes, hours, days or weeks.

If the monitored pressure remains substantially constant or does not have more than a selected insignificant variation through the selected period of time then the well seal provided by the cement plug 2 is approved as being adequate, whereas if the monitored pressure does not maintain substantially constant or has more than a selected variation the well seal provided by the cement plug 2 is qualified as inadequate and an additional cement plug and/or other well seal needs to be placed of which the adequacy will also be tested using the smart test plug 6 according to the invention.

Therefore, the method and system according to present invention are well adapted to attain the ends and advantages mentioned as well as those that are inherent therein.

The particular embodiments disclosed above are illustrative only, as the present invention may be modified, combined and/or practiced in different but equivalent manners apparent to those skilled in the art having the benefit of the teachings herein.

Furthermore, no limitations are intended to the details of construction or design herein shown, other than as described in the claims below.

It is therefore evident that the particular illustrative embodiments disclosed above may be altered, combined and/or modified and all such variations are considered within the scope of the present invention as defined in the accompanying claims.

While any methods, systems and/or products embodying the invention are described in terms of "comprising," "containing," or "including" various described features and/or steps, they can also "consist essentially of" or "consist of" the various described features and steps.

All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values.

Also, the terms in the claims have their plain, ordinary meaning unless otherwise explicitly and clearly defined by the patentee.

Moreover, the indefinite articles "a" or "an", as used in the claims, are defined herein to mean one or more than one of the element that it introduces.

If there is any conflict in the usages of a word or term in this specification and one or more patent or other documents that may be cited herein by reference, the definitions that are consistent with this specification should be adopted.

That which is claimed is:

1. A smart test plug for inspecting the integrity of a barrier in an underground wellbore, the smart test plug comprising:

a pair of expandable seals configured to seal off an annular space between the pair of expandable seals and a surrounding inner surface of the wellbore, thereby defining an intermediate wellbore section below the pair of expandable seals between the smart test plug and the barrier;

a pump for pumping fluid through a fluid channel traversing the smart test plug between a the intermediate wellbore section located between the smart test plug and the barrier and an upper wellbore section located above the pair of expandable seals and the smart test plug;

a valve for closing the fluid channel after a pressure difference between the upper wellbore section and the intermediate wellbore section has reached a selected level;

pressure gauges for monitoring pressure in the upper and the intermediate wellbore sections and in the annular space; and a signal transmitter for transmitting the pressure monitored by the pressure gauges to a barrier and smart test plug seal integrity monitoring display at an earth surface.

2. The smart test plug of claim 1, wherein the smart test plug is connected to a wireline or coiled tubing, which is provided with a power and data transmission assembly for activating the pair of expandable seals, the pump, the valve and the pressure gauges, and for transmitting the monitored pressure to the barrier and smart test plug seal integrity monitoring display at the earth surface.

3. The smart test plug of claim 2, wherein the barrier and smart test plug seal integrity monitoring display is configured to indicate a lack of integrity of the barrier if after activating the pump to generate the pressure difference between the upper wellbore section and the intermediate wellbore section and closing off the fluid channel the pressure gauges in the intermediate wellbore section measures a pressure change that exceeds a predetermined threshold during a selected period of time and to indicate a lack of sealing performance of at least one of the pair of expandable seals if at least one of the pressure gauges in the annular space measures a pressure change that exceeds a predetermined value during the selected period of time.

4. A method for assessing the integrity of a barrier in an underground wellbore, the method comprising:

lowering the smart test plug of claim 1 into the underground wellbore to a location above the barrier, said smart test plug comprising the pair of expandable seals, the pump, the valve, the pressure gauges and the signal transmitter;

activating the pair of expandable seals thereby sealing off the annular space between the pair of expandable seals and the surrounding inner surface of the wellbore;

activating the pump thereby pumping fluid through the fluid channel until the pressure difference between the upper wellbore section and the intermediate wellbore section has reached a selected level;

closing the fluid channel after the pressure difference between the upper wellbore section and the intermediate wellbore section has reached said selected level;

monitoring pressure in the upper wellbore section and the intermediate wellbore section and in the annular space with the pressure gauges; and transmitting the pressure monitored by the pressure gauges with the signal transmitter to the barrier and smart test plug seal integrity monitoring display at the earth surface.

5. The method of claim 4, wherein the barrier is a cement plug set in an abandoned oil and/or a gas production well.

6. The method of claim 5, wherein the smart test plug is suspended from a wireline or a coiled tubing and is lowered to a location just above an upper end of the cement plug.

7. The method of claim 5, wherein the wellbore has a substantially horizontal or inclined bottom section and the smart test plug is connected to a robotic carrier tool or a coiled tubing which moves the smart test plug to a position in a vicinity of the cement plug in the bottom section of the wellbore and the robotic carrier tool and/or the smart test plug comprises a battery for powering the pair of expandable seals, the pump, the valve and the pressure gauges.

8. The method of claim 7, wherein the robotic carrier tool and/or the smart test plug comprises a memory for storing the pressure measured by the pressure gauges in the intermediate wellbore section between the smart test plug and the cement plug and in the annular space between the pair of expandable seals during a selected period of time.

9. The method of claim 7, wherein the robotic carrier tool and/or the smart test plug comprises a wireless signal transmitter for transmitting the monitored pressure to the display at the earth surface.

10. The method of claim 4, wherein the smart test plug comprises a pair of check valves or remotely controlled valves in a fluid passage below the pump and a pressure gauge arranged in the fluid passage between the pair of check valves or remotely controlled valves to monitor a sealing integrity of the pair of check valves or remotely controlled valves.

11. The method of claim 10, wherein a space and at least part of the upper section of the wellbore above the smart test plug are filled with water or another liquid during the barrier and smart test plug seal integrity test.

12. The method of claim 4, wherein:

the smart test plug comprises an upper part and a lower part;

the lower part comprises a first expandable seal of the pair of expandable seals and remains permanently in place above the barrier; and the upper part comprises a second expandable seal of the pair of expandable seals and the pump and is lowered by a wireline or a coiled tubing on top of the lower part to form a seal when a barrier integrity test is performed and subsequently hoisted by the wireline or the coiled tubing to the earth surface.

13. The method of claim 12, wherein the upper part is lowered again on top of the lower part if the integrity of the barrier is to be monitored again after an earlier test according to the method of claim 12 has been performed.

14. A smart test plug for inspecting the integrity of a barrier in an underground wellbore, the smart test plug comprising:

a pair of expandable seals configured to seal off an annular space between the pair of expandable seals and a surrounding inner surface of the wellbore, thereby defining an intermediate wellbore section below the pair of expandable seals between the smart test plug and the barrier;

a pump for pumping fluid through a fluid channel traversing the smart test plug between a the intermediate wellbore section located between the smart test plug and the barrier and an upper wellbore section located above the pair of expandable seals and the smart test plug;

a pair of check valves or remotely controlled valves, for closing the fluid channel after a pressure difference between the upper wellbore section and the intermediate wellbore section has reached a selected level; and pressure gauges for monitoring pressure in the upper wellbore section and the intermediate wellbore section and in the annular space.

15. The smart test plug of claim 14, further comprising:

a data transmission cable for transmitting the pressures monitored by the pressure gauges to a barrier and smart test plug seal integrity monitoring display at an earth surface.

16. The smart test plug of claim 15, wherein the data transmission cable is embedded in a wireline.

17. The smart test plug of claim 14 further comprising:

a wireless link for transmitting the pressure monitored by the pressure gauges to a barrier and smart test plug seal integrity monitoring display at an earth surface.

18. The smart test plug of claim 14 further comprising:

a memory device for storing pressure gauge readings from the pressure gauges.

19. A method for assessing the integrity of a barrier in an underground wellbore using the smart test plug of claim 14.

20. The method of claim 19, wherein the smart test plug is suspended from a wireline or a coiled tubing and is lowered to a location just above an upper end of a cement plug set in an abandoned oil and/or gas production well.

* * * * *